US006889638B2

(12) United States Patent
Denteler et al.

(10) Patent No.: US 6,889,638 B2
(45) Date of Patent: May 10, 2005

(54) INTERNAL COMBUSTION ENGINE COMPRISING AN ELECTROMAGNETIC ACTUATOR WHICH IS SITUATED ON A CYLINDER HEAD

(75) Inventors: Johannes Denteler, Moosburg (DE); Johannes Meyer, Karlsfeld (DE); Helmut Kellermann, Oberschleissheim (DE); Andreas Donner, Suhl (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 10/416,726

(22) PCT Filed: Oct. 23, 2001

(86) PCT No.: PCT/EP01/12229

§ 371 (c)(1),
(2), (4) Date: May 14, 2003

(87) PCT Pub. No.: WO02/40834

PCT Pub. Date: May 23, 2002

(65) Prior Publication Data

US 2004/0020451 A1 Feb. 5, 2004

(30) Foreign Application Priority Data

Nov. 15, 2000 (DE) ..... 100 56 572

(51) Int. Cl.[7] ..... F01L 9/04
(52) U.S. Cl. ..... 123/90.11; 123/90.15
(58) Field of Search ..... 123/90.11, 90.15

(56) References Cited

U.S. PATENT DOCUMENTS

| | | | | |
|---|---|---|---|---|
| 3,882,833 A | | 5/1975 | Longstaff et al. | |
| 5,199,392 A | * | 4/1993 | Kreuter et al. | 123/90.11 |
| 5,772,179 A | * | 6/1998 | Morinigo et al. | 251/129.1 |
| 5,797,360 A | * | 8/1998 | Pischinger et al. | 123/90.11 |
| 6,116,570 A | * | 9/2000 | Bulgatz et al. | 251/129.1 |

FOREIGN PATENT DOCUMENTS

| | | |
|---|---|---|
| DE | 2 335 150 | 1/1974 |
| DE | 19706106 A1 | 8/1998 |
| DE | 19712669 A1 | 10/1998 |

OTHER PUBLICATIONS

Form PCT/IPEA/416 (1 page) , Form PCT/IPEA/409 (5 pages) , one sheet including German language claim 1, and partial English translation (2 pages).

* cited by examiner

*Primary Examiner*—Thomas Demion
*Assistant Examiner*—Zelalem Eshete
(74) *Attorney, Agent, or Firm*—Crowell & Moring LLP

(57) ABSTRACT

An internal combustion engine includes an electromagnetic actuator for operating a gas exchange valve, this actuator being situated on a cylinder head. The actuator includes a switchable electromagnet which is situated between two armatures. The armatures are axially set apart on a common armature shaft. A cavity is configured in the cylinder head, in which the actuator armature on the cylinder head side is at least partially accommodated, and the electromagnet at least partially delimits the cavity on the actuator side. This results in a compact internal combustion engine.

19 Claims, 1 Drawing Sheet

INTERNAL COMBUSTION ENGINE COMPRISING AN ELECTROMAGNETIC ACTUATOR WHICH IS SITUATED ON A CYLINDER HEAD

BACKGROUND AND SUMMARY OF THE INVENTION

This invention concerns an internal combustion engine with an electromagnetic actuating mechanism arranged on a cylinder head.

Such an actuating mechanism is known from German patent document DE 197 12 669 A1. Moreover, an electromagnet is arranged between two anchors in an axially spaced construction on the valve tappet. A coil core of the electromagnet has one or more pole surfaces on the respective sides facing the anchors. When the electromagnet is subjected to current, a force acting upon the respective closest anchor predominates. In particular, an alternating motion of the actuating mechanism and consequently an opening and closing of the gas exchange valve coupled with it can be realized in the interaction with the dynamics of the actuating mechanism through an alternating interruption and subjection to the current in the exciter circuit.

The problem in any case with the arrangement of such actuators on cylinder heads is the overall height. When actuating mechanisms are built too high, space problems can arise in the motor area. In particular, problems can arise during motor vehicle assembly and when positioning the motor in the motor space.

For this reason, it is one object of the present invention to specify an internal combustion engine that is compactly constructed to a particular measurement.

This object is reached by the measures specified in claim 1.

Moreover, basic to the invention is the construction of a hollow space in the cylinder head that accommodates a part of the actuating mechanism. This component is mainly, at least in part, the cylinder head side anchor of the actuator unit, whereby the electromagnet lying between the anchors at least partially delimits the hollow space mentioned on the actuator side. Through the formation of the hollow space mentioned above, and by shifting the actuator elements into the hollow space that then becomes possible, the height can be reduced significantly in the direction of the cylinder, which leads to a more compact internal combustion engine overall, especially taking into account the large number of actuator mechanisms to be installed.

Above and beyond this, favorable heat extraction can be attained by directly positioning the electromagnet on the cylinder head so that the actuator can easily be cooled.

In accordance with an advantageous design, the anchor shaft is mounted in the electromagnet itself. In this way, it is important to fix the electromagnet into a position relative to the cylinder head.

The anchor shaft of the actuating mechanism can be indirectly or directly coupled with the valve shaft of the valve, for example, by interposing a valve play compensation element.

In order to utilize the hollow space even better, a first spring (valve spring) should be installed according to an especially advantageous design of the invention. This valve spring can prestress the valve into an end position, for example the closed position. The valve spring is moreover advantageously braced on the valve shaft, on the one hand, and on the cylinder head, on the other. This makes it possible to install the valve in a simple manner.

A second spring (actuator spring) can be incorporated into the actuating mechanism and can be installed far from the cylinder head in relation to the electromagnet. The simple construction of this design is furthered if this actuator unit spring is braced directly against the anchor far from the cylinder head. Through a screw device by means of which the actuator spring can be held above a spring seat, an adjustment of the actuator unit, especially of the two anchor plates, can moreover be conducted with respect to its position toward the electromagnet. The electromagnet can include a coil core with one or more pole surfaces as is known, for example, from German patent document DE 197 12 669 A1.

The present invention will be explained in greater detail below on the basis of a design and with reference to the appended drawings.

DETAILED DESCRIPTION OF THE INVENTION

Figure 1:
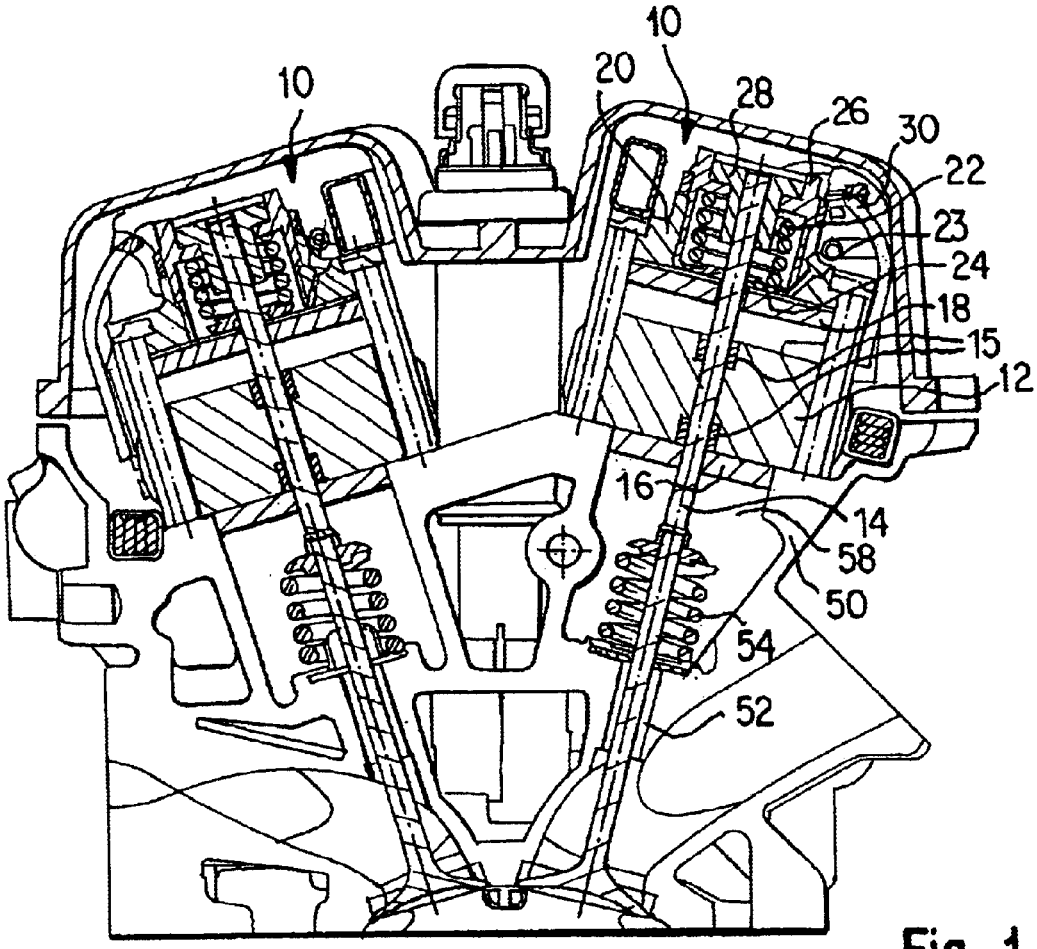
FIG. 1 is a sectional representation of a unit formed by two electromagnetic valves which are arranged on a cylinder head.

In FIG. 1, an assembled unit is represented in cross-section, which basically consists of two electromagnetically activated gas valves arranged on a cylinder head.

Figure 2:
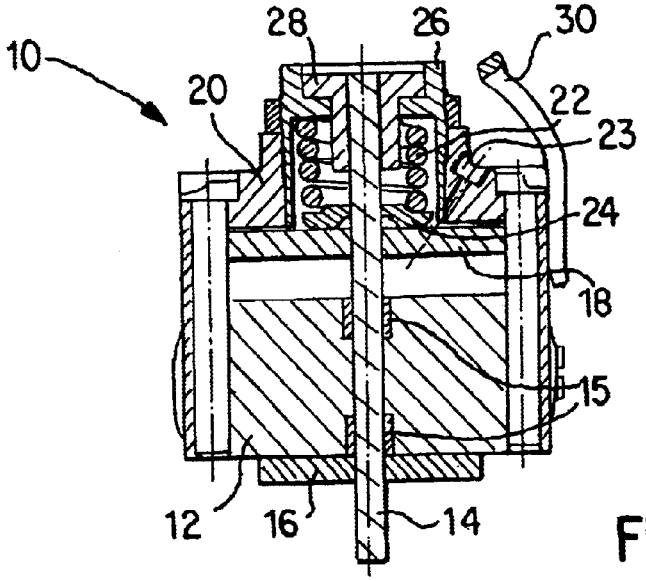
FIG. 2 is a sectional representation of an actuating mechanism constructed in accordance with the invention.

The structure of an electromagnetic actuating mechanism for such a gas valve is first described on the basis of FIG. 2.

The actuator 10 includes an electromagnet 12 that is only represented as a unit. The electromagnet 12 can encompass one or more pole surfaces on the sides facing the respective anchors as one or more coils. Two bearings 15 are constructed in the electromagnet coaxially with a central bore hole on both end regions that hold an anchor shaft 14 flexibly guided in an axial direction. Two anchor plates 16 and 18 are spaced at a distance from each other axially on the anchor shaft. They are located on opposite sides of the electromagnet 12. The front anchor plate 16 is constructed smaller than anchor plate 18. In a zero point position of the anchors that are the same distance from the electromagnet 12, this asymmetry is important for oscillations of the actuating mechanisms in the starting position of the combustion engine as the pressure is greater on the upper anchor plate 18 than the on the lower anchor plate 16. The distance between the two anchor plates 16 and 18 is greater than the thickness of the electromagnet 12 so that an alternating motion is guaranteed in a specified region.

The electromagnet 12 is accommodated in a housing 20 such that, together with the housing 20, it basically delimits the actuating mechanism on the side of the small anchor plate 16. In this way, the anchor plate 16 stands together with the anchor shaft 14 projecting on this side over the volume bounded by the electromagnet 12 and the housing 20.

In the upper region of the housing 20 represented in FIG. 2, a bore hole oriented coaxially toward the bore hole in the electromagnet 12 is constructed with an internal thread into which a screw device 26 can be rotated. At the same time, the screw device 26 forms a spring seat for an actuating mechanism spring 22 that is first braced against this spring seat and secondly against a valve seat arranged directly on anchor plate 18. The actuator spring 22 serves to prestress the gas exchange valve in the open position and is compressed in the design presently represented. The screw in device 26 includes above and beyond this a central, stepped bore hole into which a path sensor 28 (presently not represented in greater detail) is inserted. The path sensor 28 once again includes a central borehole arranged coaxially toward the cylinder borehole through which a prolongation of the anchor shaft 14 projects.

Subjecting the electromagnet 12 to current takes place through feeder lines of which only one is presently represented with reference number 30.

A so-called oil gallery is designated with reference number 23. This is a supply line for lubricating oil that terminates in the region of the upper anchor plate 18 and assures minimal lubrication through a drop-by-drop administration of lubricating oil.

In accordance with FIG. 1, a cylinder head 50 of the internal combustion engine is constructed with a recess (hollow space) 58 in the region of each valve in which the actuator element (anchor plate 16 and anchor shaft 14) is accommodated, projecting beyond the housing 20 and electromagnet 12. Moreover, the valve 52 that is mounted in the cylinder head stands opposite the actuating mechanism into the hollow space 58.

A spring seat 56 is mounted on the upper end of the valve 52 against which additional springs, namely the valve springs 54, are braced. The valve spring 54 is on the other hand braced against a spring seat directly on the cylinder head and prestresses the valve in its closed direction. A valve play compensation element not represented in greater detail is provided on the upper end of the valve.

During assembly, the anchor plate 16 together with the anchor shaft 14 is introduced into the hollow space 58 so that the front end of the anchor shaft comes to lie on the valve shaft of the gas exchange valve arranged therein by interposition of the valve play compensation element. In this way, there exists a coupling between the actuating mechanism 10 and the valve 52. An anchor position is reached through a suitable dimensioning and arrangement of springs 22 and 54 or the corresponding spring seats, in which the electromagnet comes to lie approximately between the two anchor plates 16 and 18 (not presently represented). This represents the resting position. Through the present, asymmetrical choice of the two anchor plates 16 and 18, an initial displacement can be attained during start-up by subjecting the electromagnet to current so that ultimately an alternating oscillation of the spring aggregate system consists of anchor, valve and valve spring with subsequent, suitable alternate presence and absence of current. Moreover, the lower anchor plate 16 alternates in the hollow space. Both anchors 16, 18 can be held in their respective end positions near the electromagnet through continuous administration of current.

The hollow space is predominantly bounded by the electromagnet on the actuator unit side. By accommodating valve and actuator unit elements in the hollow space 58, an especially concisely built unit consisting of the cylinder head and actuating mechanisms can be achieved, which is the goal of the present invention.

In addition to this, the electromagnet 12 lies directly on the cylinder head, at least in its edge regions, which is always well cooled. Through this optimal thermal coupling, good heat dissipation of the heat generated in the in the actuating mechanism is achieved, especially the electromagnet 12 itself, without having to take special cooling measures for the actuating mechanism.

What is claimed is:

1. An internal combustion engine with an electromagnetic actuating mechanism arranged on a cylinder head for operating a gas exchange valve, the actuating mechanism comprising:

a switchable electromagnet, and two movable anchors arranged axially at a distance on a common anchor shaft on which the switchable electromagnet is mounted, wherein a hollow space is constructed in the cylinder head and a cylinder side anchor of the actuating mechanism is at least partially accommodated in the hollow space, wherein the electromagnet at least partially delimits the hollow space, and wherein the electromagnet lies at least in part directly on the cylinder head and is thermally coupled with the cylinder head.

2. The internal combustion engine according to claim 1, wherein the anchor shaft is mounted in the electromagnet.

3. The internal combustion engine according to claim 2, wherein a penetrating bearing is or at least two bearings are provided.

4. The internal combustion engine according to claim 1, wherein the anchor shaft is indirectly or directly coupled with a valve shaft of the valve, and wherein the valve is mounted in the cylinder head.

5. The internal combustion engine according to claim 4, wherein a valve play compensation element is provided between the anchor shaft and the valve shaft.

6. The internal combustion engine according to claim 4, wherein a first spring that prestresses the valve into an end position is provided in the hollow space.

7. The internal combustion engine according to claim 6, wherein the first spring prestresses the valve in its closed position.

8. The internal combustion engine according to claim 6, wherein the first spring is supported on both the valve shaft and on the cylinder head.

9. The internal combustion engine according to claim 6, wherein a second spring is arranged at a distance from the cylinder head in relation to the electromagnet.

10. The internal combustion engine according to claim 9, wherein the second spring is braced against the anchor at a distance from the cylinder head.

11. The internal combustion engine according to claim 9, wherein the second spring is braced against a spring seat that is held by a screw device by which an adjustment of the actuating mechanism can be conducted.

12. The internal combustion engine according to claim 1, wherein a sensor for detecting anchor positions is provided on one end of the actuating mechanism.

13. The internal combustion engine according to claim 1, wherein the electromagnet includes at least one coil core with one or more pole surfaces.

14. The internal combustion engine according to claim 1, wherein the two movable anchors have different dimensions.

15. The internal combustion engine according to claim 1, wherein an oil supply tube terminates in the upper part of the actuating mechanism through which lubrication can be obtained using drop-by-drop oil provision.

16. The internal combustion engine according to claim 4, wherein the anchor shaft is mounted in the electromagnet.

17. The internal combustion engine according to claim 2, wherein a sensor for detecting anchor positions is provided on one end of the actuating mechanism.

18. The internal combustion engine according to claim 2, wherein the electromagnet includes at least one coil core with one or more pole surfaces.

19. The internal combustion engine according to claim 2, wherein the two movable anchors have different dimensions.

* * * * *